US010633794B2

(12) United States Patent
Tolfsson et al.

(10) Patent No.: US 10,633,794 B2
(45) Date of Patent: Apr. 28, 2020

(54) METHOD OF MAKING A STRUCTURED FIBROUS WEB AND A CREPED FIBROUS WEB

(71) Applicant: Valmet Aktiebolag, Sundsvall (SE)

(72) Inventors: Karl-Johan Tolfsson, Forshaga (SE); Ingvar Klerelid, Karlstad (SE); Allan Grimm, Karlstad (SE); Hans Ivarsson, Karlstad (SE)

(73) Assignee: Valmet Aktiebolag, Sundsvall (SE)

( * ) Notice: Subject to any disclaimer, the term of this patent is extended or adjusted under 35 U.S.C. 154(b) by 148 days.

(21) Appl. No.: 15/561,452

(22) PCT Filed: May 19, 2016

(86) PCT No.: PCT/SE2016/050461
§ 371 (c)(1),
(2) Date: Sep. 25, 2017

(87) PCT Pub. No.: WO2016/186562
PCT Pub. Date: Nov. 24, 2016

(65) Prior Publication Data

US 2018/0119353 A1 May 3, 2018

(30) Foreign Application Priority Data

May 19, 2015 (SE) ..... 1550636

(51) Int. Cl.
*D21F 11/00* (2006.01)
*D21F 11/14* (2006.01)
(Continued)

(52) U.S. Cl.
CPC ..... *D21F 11/006* (2013.01); *D21F 11/14* (2013.01); *D21H 27/005* (2013.01);
(Continued)

(58) Field of Classification Search
CPC ..... D21F 9/00; D21F 9/003; D21F 11/006; D21F 11/06; D21F 11/14; D21F 11/145;
(Continued)

(56) References Cited

U.S. PATENT DOCUMENTS 3,905,863 A 9/1975 Ayers
4,239,065 A 12/1980 Trokhan
(Continued)

FOREIGN PATENT DOCUMENTS

WO WO 1998/055690 A1 12/1998
WO WO 2005/103375 A1 11/2005
(Continued)

OTHER PUBLICATIONS

Smook, Gary A., Handbook for Pulp & Paper Technologists, pp. 237-238, Angus Wilde Publications (Year: 1992).*
(Continued)

*Primary Examiner* — Eric Hug
(74) *Attorney, Agent, or Firm* — Alston & Bird LLP

(57) ABSTRACT

The invention relates to a method of making a structured fibrous web (W). The method comprises forming a fibrous web (W) and conveying the formed fibrous web on a water receiving felt (5) to a dewatering nip (PN) formed by a first press unit (8) and a second press unit (9) and where an endless belt (11) is passed through the nip together with the fibrous web 5 (W) and the water receiving felt (5), The endless belt has a side which is covered by a polymer and which contacts the fibrous web (W) in the dewatering nip (PN). After the dewatering nip, the web (W) is transferred with a speed difference to an endless structured clothing (12) which is permeable to air and has protruding knuckles (40) on the side that contacts the fibrous web (W) and which protruding knuckles (49) give the structured clothing (12) a topographic surface 10 area which, for a given length of the
(Continued)

structured clothing (12) in the machine direction and a given width of the structured clothing in the cross machine direction, exceeds the plain surface area of a part of the endless belt (11) having an equal length and width. The structured clothing is operated at a speed which is so much lower than the speed of the endless belt (11) that the relative difference in speed between the endless belt (11) and the structured (12) fabric 15 corresponds to the relative difference in surface area between the endless belt (11) and the structured clothing. In this way, the fibers of the fibrous web (W) will be evenly distributed on the structured clothing (12). The invention also relates to a creped fibrous web (W) having a basis weight in the range of 14 g/m$^2$-40 g/m$^2$, and having a three-dimensional structure formed by depressed regions (45) and elevated regions (46). The fibers of the fibrous web (W) are 20 evenly distributed over the surface of the creped fibrous web (W).

19 Claims, 5 Drawing Sheets

(51) Int. Cl.

| | |
|---|---|
| ***D21H 27/00*** | (2006.01) |
| ***D21H 27/02*** | (2006.01) |
| ***D21H 27/40*** | (2006.01) |
| *B31F 1/12* | (2006.01) |
| *D21F 9/00* | (2006.01) |

(52) U.S. Cl.
CPC ..... *D21H 27/007* (2013.01); *D21H 27/02* (2013.01); *D21H 27/40* (2013.01); *B31F 1/12* (2013.01); *B31F 1/126* (2013.01); *D21F 9/003* (2013.01)

(58) Field of Classification Search
CPC ..... D21H 27/002; D21H 27/02; D21H 27/40; D21H 27/004; D21H 27/005; D21H 27/007; B31F 1/12; B31F 1/126
USPC ..... 162/111, 113, 116, 296
See application file for complete search history.

(56) References Cited

U.S. PATENT DOCUMENTS

| | | | | |
|---|---|---|---|---|
| 5,772,845 | A | 6/1998 | Farrington, Jr. et al. | |
| 5,798,024 | A * | 8/1998 | Odell | D21F 9/003 162/203 |
| 5,972,813 | A | 10/1999 | Polat et al. | |
| 6,187,137 | B1 | 2/2001 | Druecke et al. | |
| 6,193,847 | B1 | 2/2001 | Trokhan | |
| 6,287,426 | B1 | 9/2001 | Edwards et al. | |
| 7,527,708 | B2 | 5/2009 | Gustavsson | |
| 8,568,560 | B2 | 10/2013 | Murray et al. | |
| 8,871,060 | B2 | 10/2014 | Klerelid | |
| 2006/0289133 | A1 * | 12/2006 | Yeh | B31F 1/126 162/109 |
| 2008/0110591 | A1 * | 5/2008 | Mullally | D21F 11/006 162/358.2 |
| 2009/0136722 | A1 | 5/2009 | Nyangiro et al. | |
| 2010/0065234 | A1 | 3/2010 | Klerelid et al. | |
| 2010/0236735 | A1 | 9/2010 | Goulet et al. | |
| 2012/0043041 | A1 | 2/2012 | Polat et al. | |
| 2012/0043042 | A1 | 2/2012 | Polat et al. | |
| 2012/0244320 | A1 * | 9/2012 | Sauter | B31F 1/07 428/156 |
| 2014/0130997 | A1 * | 5/2014 | Klerelid | D21F 11/006 162/217 |
| 2014/0284012 | A1 * | 9/2014 | Gustavsson | D21F 3/0281 162/206 |
| 2016/0130762 | A1 * | 5/2016 | Ramaratnam | D21H 17/24 162/129 |

FOREIGN PATENT DOCUMENTS

| | | |
|---|---|---|
| WO | WO 2007/001837 A2 | 1/2007 |
| WO | WO 2008/051150 A1 | 5/2008 |
| WO | WO 2008/105005 A1 | 9/2008 |
| WO | WO 2009/067079 A1 | 5/2009 |
| WO | WO 2013/009256 A1 | 1/2013 |

OTHER PUBLICATIONS

International Searching Authority, International Search Report and Written Opinion for International Application No. PCT/SE2016/050461, dated Sep. 1, 2016, 16 pages, Swedish Patent and Registration Office, Sweden.

* cited by examiner

METHOD OF MAKING A STRUCTURED FIBROUS WEB AND A CREPED FIBROUS WEB

CROSS REFERENCE TO RELATED APPLICATIONS

This application is a National Stage Application, filed under 35 U.S.C. § 371, of International Application No. PCT/SE2016/050461, filed May 19, 2016, which claims priority to Swedish Application No. 1550636-3, filed May 19, 2015; the contents of both of which as are hereby incorporated by reference in their entirety.

BACKGROUND

Related Field

The present invention relates to a method of making a structured fibrous web and to a creped fibrous web.

DESCRIPTION OF RELATED ART

Methods of manufacturing soft tissue paper such as, for example, bathroom tissue or kitchen towel usually aim at achieving a product with high bulk and softness. A known way of achieving high bulk and high softness is to use through-air drying (TAD) and through-air drying is a technology that is known to produce tissue paper products of high quality. However, through-air drying is a method that requires much energy and it is thus desirable to develop alternative technical solutions for manufacturing tissue paper that is soft and has a high bulk. One alternative method is disclosed in, for example, U.S. Pat. No. 5,972,813 to Polat et al. In that patent, a method is disclosed in which an impermeable belt with a pattern that can be imposed to a paper is used. In U.S. Pat. No. 6,287,426, a machine is described that uses a clothing with a structured side having depressions and wherein the clothing is arranged to pick up a fibrous web from a smooth impermeable belt at a speed that is equal to or less than the speed of the impermeable belt and the difference in speed can be 10-25 percent. A variation of the method and machine disclosed in U.S. Pat. No. 6,287,426 is disclosed in U.S. Pat. No. 8,871,060. In U.S. Pat. No. 8,871,060, the pick-up point where the fibrous web is picked up from a smooth belt is arranged in a transfer nip to a textured fabric. It is explained in U.S. Pat. No. 8,871,060 that the use of a transfer nip with a short transfer nip having a length which is 5 mm-40 mm reduces the risk that the web is damaged and that this is of particular importance when the speed difference between the smooth belt and the clothing with a structured side is greater than 8%. According to U.S. Pat. No. 8,871,060, a speed difference between the belt and the textured fabric improves bulk and it is stated that speed differences up to as much as 25% may be desirable. Another example of a machine making use of a speed difference is disclosed in U.S. Pat. No. 8,568,560. In that patent, a method is disclosed in which a fibrous web is manufactured that has fiber-enriched regions interconnected by lower local basis weight linking regions. It is an object of the present invention to provide an improved method of manufacturing fibrous webs intended for use as tissue paper such as bathroom tissue or kitchen towel and in which method the risk of damage to the fibrous web during manufacturing is reduced. It is a further object of the invention to provide a creped fibrous web that can be used for such purposes as, for example, bathroom tissue or kitchen towel.

BRIEF SUMMARY

The invention relates to a method of making a structured fibrous web. The method comprises forming a fibrous web and conveying the formed fibrous web on a water receiving felt to a dewatering nip formed by a first press unit and a second press unit. An endless belt is passed through the nip together with the fibrous web and the water receiving felt and the endless belt has a side which is covered by a polymer such as polyurethane and has a plain (smooth) surface and which contacts the fibrous web in the dewatering nip. After the dewatering nip, the method further comprises conveying the fibrous web by the endless belt to an endless structured clothing which is permeable to air and which has protruding knuckles that give the structured clothing a topographic surface area which, for a given length of the structured clothing in the machine direction (and of a given width) exceeds the plain (smooth) surface area of a part of the endless belt having an equal length and width, and to which structured clothing the fibrous web is transferred from the endless belt in a transfer nip formed between a first transfer nip roll that lies within the loop of the endless belt and a second transfer nip roll which is a suction roll located within the loop of the structured clothing. The transfer nip has a length in the machine direction which is in the range of 5 mm-40 mm. The use of a short transfer nip having a length of 5 mm-40 mm reduces the risk of web damage. After the transfer to the structured clothing, the fibrous web is conveyed to a drying cylinder and the web is dried on the drying cylinder and the dried web is subsequently creped from the surface of the drying cylinder. The structured clothing is operated at a speed which is so much lower than the speed of the endless belt that the relative difference in speed between the endless belt and the structured clothing corresponds to the relative difference in surface area between the plain endless belt and the structured clothing such that the fibers of the fibrous web will be evenly distributed on the structured clothing.

In embodiments of the invention, the structured clothing has yarns extending in the cross machine direction and in the machine direction and which yarns form the protruding knuckles. On the side of the structured clothing that faces the fibrous web, the protrusions formed by the yarns have a greater extension in the machine direction than in the cross machine direction. That the knuckles have a longer extension in the machine direction is a feature which can be advantageous also for structured clothings not made by interwoven yarns.

In embodiments of the invention, the fibrous web is dewatered to a dry solids content in the range of 40%-50% in the dewatering nip, preferably to a dry solids content which is in the range of 45%-50%.

In embodiments of the invention, the speed of the endless belt has a speed that is 2%-18% higher than the speed of the structured clothing, preferably 3%-12%.

In embodiments of the invention, the linear load in the dewatering nip is in the range of 250-700 kN/m corresponding to a peak pressure in the range of 2.5 MPa-7 MPa.

In embodiments of the invention, the suction roll in the transfer nip may suitably be operated at an internal underpressure in the range of 20 kPa-65 kPa, preferably 45 kPa-65 kPa and even more preferred 48 kPa-58 kPa.

In embodiments of the invention, the transfer nip between the first transfer nip roll and the second transfer nip roll is operated at a linear load in the range of 4 kN/m-15 kN/m, preferably a linear load in the range of 4 kN/m-10 kN/m and even more preferred 4 kN/m-8 kN/m.

A vacuum box may optionally be arranged within the loop of the structured clothing at a point between the transfer nip and the drying cylinder and arranged to act on the fibrous web through the structured clothing at an internal under-pressure in the vacuum box which is in the range of 40 kPa-70 kPa, preferably 55 kPa-65 kPa.

In embodiments of the invention, the fibrous web is transferred to the drying cylinder in a transfer nip between the drying cylinder and a third transfer nip roll located inside the loop of the structured clothing. The linear load in the transfer nip between the drying cylinder and the third transfer nip roll may be in the range of 30 kN/m-90 kN/m, preferably in the range of 65 kN/m-75 kN/m.

The dried fibrous web may optionally be calendered after it has been creped from the surface of the drying cylinder.

When the structured clothing is made of interwoven yarns, the yarns may have a diameter in, for example, the range of 0.30 mm-0.55 mm but other numerical values are conceivable. The structured clothing may have an air permeability in the range of 550-650 cfm.

The forming step may advantageously (but not necessarily) be carried out in such a way that a head box ejects stock over a forming fabric or into a gap between two forming fabrics and the speed of the stock ejected from the head box is selected to be lower than the speed of the forming fabric or forming fabrics such that the fibers in the stock obtain an orientation that is biased in the machine direction (MD).

The invention also relates to a creped fibrous web having a basis weight in the range of 14 $g/m^2$-40 $g/m^2$, preferably 14 $g/m^2$-28 $g/m^2$ and having a three-dimensional structure formed by depressed and elevated regions, an MD/CD tensile ratio in the range of 1.1-2.7, a caliper in the range of 170 μm-350 μm, in many cases a caliper in the range of 173 μm-296 μm (the caliper measured using the thickness measurement method according to: ISO 12625-3), a water absorbency in the range of 8 g/g-14 g/g, or in some cases 8 g/g-13 g/g (the absorbency measured using the basket method according to: ISO 12625-8) and wherein the fibers of the fibrous web are evenly distributed over the surface of the creped fibrous web.

In embodiments of the invention, the dominant orientation of the depressed and elevated regions is in the machine direction (MD) of the fibrous web.

In embodiments of the invention, the creped fibrous web may have an MD stretch of 16%-30%.

In embodiments of the invention, the dominant orientation of the fibers is in the machine direction of the fibrous web.

DETAILED DESCRIPTION OF VARIOUS EMBODIMENTS

Figure 1:
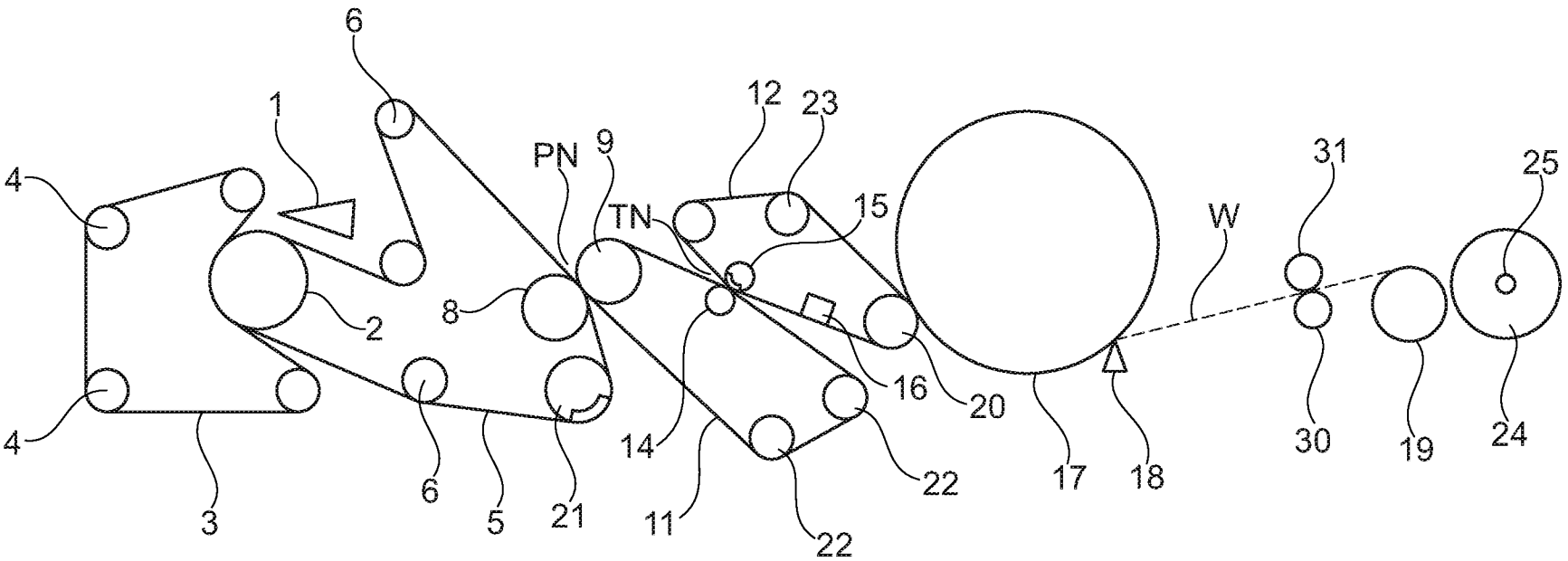
FIG. 1 is a schematic side view of a machine which can be used for the inventive method.
Figure 2:
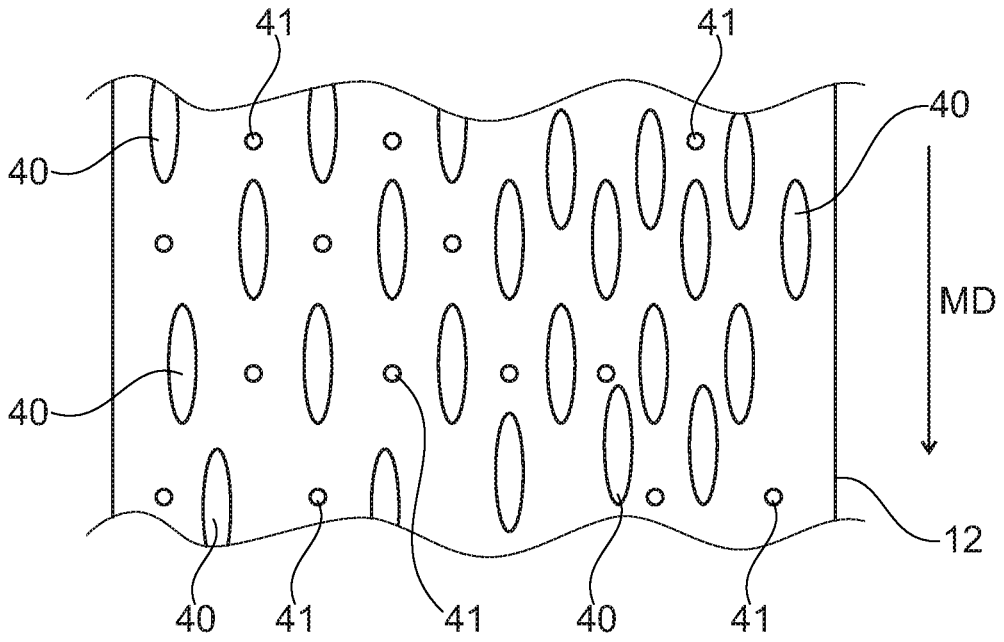
FIG. 2 is a schematic representation of a structured clothing as seen from above.

A machine suitable for practicing the inventive method and making a fibrous web according to the invention will now be explained with reference to FIG. 1. The layout of the machine according to FIG. 1 is the same as disclosed in FIG. 1 of U.S. Pat. No. 8,871,060 except that a calender has been added. The calender is symbolically and schematically indicated by calender rolls 30, 31. In the machine according to FIG. 1, a head box 1 is arranged to inject stock between forming fabrics 3 and 5 to form a fibrous web W (a paper web). The reference numeral 2 indicates a forming roll. The forming fabric 3 may be a wire and the forming fabric 5 may be, for example, a water-receiving felt. The forming fabrics are endless fabrics guided in loops by guide rolls 4 for the first forming fabric 3 and guide rolls 6 for the second forming fabric 5. Optionally, a suction roll 21 may be arranged within the loop of the second forming fabric 5 for dewatering of this fabric 5. The newly formed web W is carried by the second fabric 5 which may be a felt to a dewatering nip PN (i.e. a press nip PN) formed between a first press unit 8 and a second press unit 9. It should be understood that embodiments are conceivable in which the web W is first formed between two forming fabrics that are both wires and that the web W is then transferred to a felt. In the actual press nip PN, the fabric that has carried the fibrous web to the press nip PN will in practice be a felt. An endless belt 11 is also arranged to pass through the dewatering nip PN together with the web W and the felt 5. The endless belt 11 forms a loop and is guided by guide rolls 22. At least the side of the endless belt 11 that faces the fibrous web W is covered by a polymer such as, for example, polyurethane such that the polymer-covered side of the belt 11 will face the paper web W when the web W and the endless belt 11 pass through the nip. Polyurethane is considered to be a good choice for the surface of the endless belt 11 but other polymeric materials may be considered. The polymer-covered face of the endless belt 11 that faces the web W is smooth (plain) such that the web W will tend to adhere to the surface of the endless belt and follow the endless belt 11 after passage of the dewatering nip PN. After the dewatering nip PN, the web W will adhere to the smooth polymer-covered surface of the endless belt 11 and be carried by the endless belt 11 to a transfer nip TN downstream of the dewatering nip which transfer nip TN is formed by a first transfer nip roll 14 located within the loop of the endless belt 11 and a second transfer nip roll 15 which is a suction roll.

A structured clothing 12 runs in a loop through the transfer nip TN and the structured clothing 12 may be guided by one or several guide rolls 23. The second transfer nip roll 15 is located within the loop of the structured clothing 12. The structured clothing 12 is arranged to pick up the web W from the endless belt 11 when the web W passes the transfer nip TN such that the web W is transferred to the structured clothing 12. The transfer is secured by the second transfer nip roll 15 since this roll is a suction roll. In embodiments of the invention, the suction roll in the transfer nip TN is operated at an internal underpressure in the range of 20 kPa-65 kPa, preferably 45 kPa-65 kPa and even more preferred 48 kPa-58 kPa. A suction at this level has been found to contribute to a safe and effective transfer to the structured clothing 12 and assists in making the fibrous web adapt to the form and structure of the structured clothing 12.

The transfer nip TN between the first transfer nip roll 14 and the second transfer nip roll 15 is preferably operated at a linear load in the range of 4 kN/m-15 kN/m, preferably a linear load in the range of 4 kN/m-10 kN/m and even more preferred a linear load in the range of 4 kN/m-8 kN/m.

The structured clothing 12 is air permeable such that the second transfer nip roll 15 may draw air through the structured clothing and cause the web to adhere to the structured clothing. The air permeable structured clothing 12 may optionally—but not necessarily—be a woven fabric such as a forming wire or a through air drying fabric (TAD fabric). The smooth surface of the polymer-covered endless belt 11 makes the web adhere to the endless belt but the adhesive force is not so strong that the web cannot be picked from the endless belt 11 without substantial risk of web breaks and the suction roll ensures or contributes substantially to securing the transfer.

The structured clothing has a structure, i.e. a three-dimensional structure on at least the side facing the paper web. The structured clothing 12 imparts a three-dimensional structure on the web when the second transfer nip roll 15 (the suction roll) draws the web by suction against the structured clothing 12. Thereby, the bulk of the web is increased. The transfer from the endless belt 11 to the structured clothing 12 is made in the form of a rush transfer, i.e. there is a speed difference between the structured clothing 12 and the endless belt 11. Using a certain degree of speed difference is helpful to ensure a correct structuring of the fibrous web W. The transfer is also assisted by the vacuum in the suction roll 15 such that the transfer is achieved by vacuum combined with rush transfer.

The polymer-covered endless belt 11 is preferably a belt with a smooth surface and impermeable to water and air. An endless belt 11 with a structured surface (on the side facing the fibrous web W) and which is impermeable to water and air is considered not quite as advantageous but may in principle be considered. Embodiments are also conceivable in which the polymer-covered endless belt 11 has a limited permeability to air. The permeability to air should not exceed 0.15 m/s (corresponding to 35 CFM) at a pressure drop of 125 kPa between opposite sides of the belt. If the endless belt 11 is permeable to air, a smooth belt is the most preferred choice but a structured belt with a limited permeability (not more than 0.15 m/s) can be considered.

The use of a polymer-covered belt (the endless belt 11) is advantageous for sheet transfer. In the dewatering nip PN, the surface of the fibrous web will tend to adhere to the smooth polymer surface (such as a smooth polyurethane-covered surface) of the endless belt 11 and will follow the endless belt 11 after the dewatering nip PN instead of following the felt. However, as the web passes through the dewatering nip PN and water is forced out of the web, the dry solids content of the web increases. Compared to a web with low dry solids content, a dryer web has less adherence to the surface of a transfer fabric such as the endless belt 11. Therefore, when the web W becomes dryer, it will become easier to transfer the web W to a following fabric. Immediately after the dewatering nip PN, the web tends to adhere relatively well to the polymer-covered endless belt 11. The inventors have observed that adherence of the fibrous web W to the endless belt 11 decreases with time after passage of the dewatering nip. Without wishing to be bound by any particular theory, it is believed by the inventors that a thin water film is present on the endless belt 11 immediately after the nip and that this thin water film creates adhesion between the endless belt 11 and the fibrous web W. The polymer-covered endless belt 11 is compressed in the dewatering nip PN and expands after the nip. It is believed by the inventors that this expansion of the endless belt 11 may cause the water film to break up. When this happens, adhesion decreases. The expansion of the endless belt 11 comes gradually such that adhesion also decreases gradually. Therefore, adhesion decreases with time. Regardless of whether this explanation is correct or not, experience has showed the inventors that adhesion decreases gradually after the dewatering nip PN. For this reason, it may be justified to keep a certain distance from the dewatering nip PN to the transfer nip TN and in many practical cases, a distance of 1 m or more may be advisable in order to give the endless belt 11 time to expand. In some cases, the distance may be selected to be larger, for example up to 7 m. It should be understood that the distances mentioned are applicable to applications using a speed which is in the normal range of speed for a tissue making machine, Presently, (May, 2015) new tissue making machines may operate at a speed of up to as much as about 2200 m/minute but higher speeds have been discussed.

The degree of adhesion of the fibrous web W to the endless belt 11 is important. In and immediately after the dewatering nip PN, the adhesion of the fibrous web W to the endless belt 11 is high such that the fibrous web follows the endless belt 11 instead of following the water receiving felt 5. After the dewatering nip PN, the adhesion of the fibrous web W to the endless belt 11 decreases such that the fibrous web can be picked up more easily by the endless structured clothing 12.

The inventors had previously formed the opinion that a high speed difference between the smooth polymer-covered surface of the endless belt 11 and the structured clothing 12 was generally good and that a higher speed difference simply meant that higher bulk values could be attained. Here it can be added that transfer making use of speed difference is sometimes referred to as "rush transfer". The use of a special transfer nip TN between the endless belt 11 and the structured clothing 12 also contributed to making higher speed differences easier to reach without damage to the web in the transfer nip. However, further work by the inventors have caused the inventors to conclude that a large speed differences between the endless belt 11 and the structured clothing 12 may still lead to undesired web breaks. Without wishing to be bound by theory, the inventors have concluded that, when a paper web is transferred from a smooth polymer-covered belt, this is generally demanding for the transfer operation as such since there is inevitably a certain degree of adherence of the web to the polymer-covered smooth belt, even after expansion of the endless belt 11 has caused adherence to decrease. In some cases, the adherence may still be quite high. Moreover, the inventors have noted that a high speed difference in the transfer nip may result in a substantive redistribution of fibers such that the fibers will no longer be evenly distributed. While such a redistribution may be desirable in some contexts, the inventors of the present invention wish to achieve an even distribution of fibers to reduce the risk that the fiber web gets an uneven strength, i.e. that all parts of the fibrous web are not equally strong. Such unevenness in strength is less desirable during later handling of the fibrous web for example during converting. For most tissue paper grades, it is also generally desirable that there is a proper balance between the strength properties of the paper web. Tissue paper such as bathroom should preferably have a reasonably high strength in the length direction (the machine direction MD) but should also be capable of dissolving when flushed down so that it will not cause blocking of sewage disposal systems. Therefore, a lower strength in the CD direction may even be desirable. For bathroom grades, the MD/CD tensile ratio should therefore be selected such that it is above 1.0 and the inventors have found that an MD/CD ratio in the range of 1.1-2.7 is suitable. In some cases, a ratio of 1.5-2.7 may be even better. Also for the majority of other tissue grades, for example kitchen towel, an MD/CD ratio in the range of 1.1-2.7 may be advantageous since it gives reasonable strength in the length direction in connection with conversion and dispensing from rolls and at the same time allows the tissue paper web (the fibrous web) to be torn apart relatively easy when this is required. At the same time, the fibrous web should have high bulk and softness.

Figure 3:
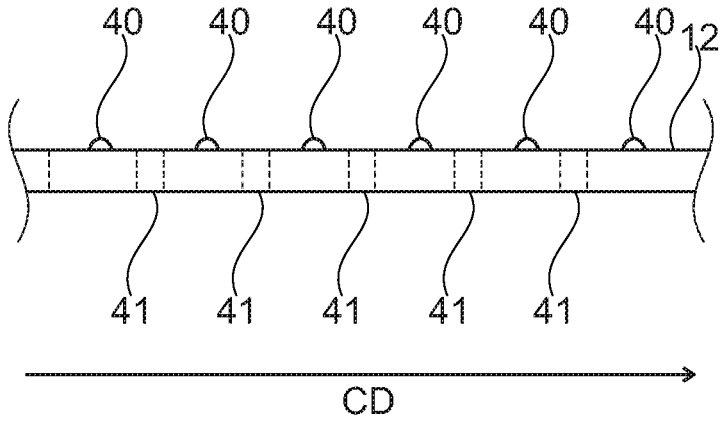
FIG. 3 is a cross sectional view of the structured clothing of FIG. 2.
Figure 4:
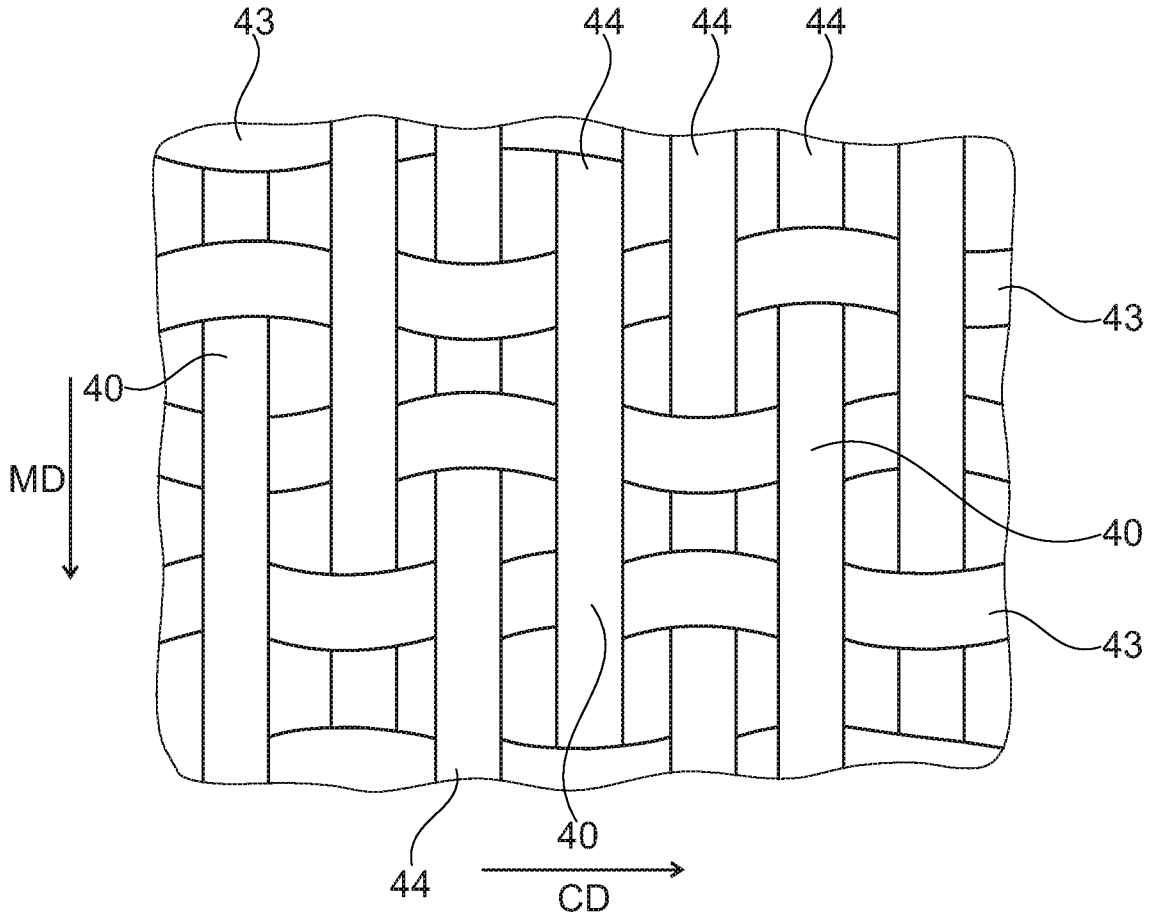
FIG. 4 is a view from above of a structured clothing made up of interwoven yarns that extend in directions substantially perpendicular to each other.

With reference to FIG. 1, the inventive method for making a structured fibrous web W comprises the steps of: forming a fibrous web W which can be made using the head box 1, the forming roll 2 and the forming fabrics 3 and 5. The formed fibrous web W is then conveyed on a water receiving felt 5 (which may be one of the forming fabrics) to the dewatering nip PN formed by the first press unit 8 and the second press unit 9. Either of the first and second press units 8, 9 may optionally be a shoe roll or a roll such as disclosed in for example, U.S. Pat. No. 7,527,708 or some other roll designed to achieve an elongated press nip. The first press unit 8 may also be a rilled or grooved roll or a suction roll. Either of the first or second press units 8, 9 may also be a deflection-compensated roll. An endless belt 11 is passed through the dewatering nip PN together with the fibrous web W and the water receiving felt 5. The endless belt 11 has a smooth side which is covered by a polymer such as for example polyurethane. The smooth and polymer-covered side of the endless belt 11 contacts the fibrous web W in the dewatering nip PN where water is pressed out of the fibrous web by the pressure in the dewatering nip. The linear load in the dewatering nip PN may take many different numerical values but in the majority of realistic cases, a suitable linear load in the dewatering nip PN will lie in the range of 250 kN/m-700 kN/m corresponding to a peak pressure in the range of 2.5 MPa-7 MPa. Much of the water that is pressed out from the fibrous web will be absorbed by the water-receiving felt 5. After the dewatering nip PN, the fibrous web W is conveyed by the endless belt 11 from the dewatering nip PN. The fibrous web W will follow the smooth surface of the endless belt 11 since a smooth belt attracts the fibrous web much more than the permeable felt. The fibrous web W is conveyed by the endless belt 11 to a transfer nip TN where the web W is transferred to an endless structured clothing 12 which is permeable to air and has protruding knuckles 40 on the side that contacts the fibrous web W. The protruding knuckles 40 give the structured clothing 12 a topographic surface area which, for a given length of the structured clothing 12 in the machine direction and a given width in the cross machine direction exceeds the surface area of a part of the plain endless belt 11 having an equal length and width. With reference to FIG. 3 and FIG. 4, which is a schematic representation of a structured clothing 12, it can be seen how the structured clothing 12 has protruding knuckles 40 and through-holes 41 that make the clothing permeable to air. It should be understood that FIG. 3 and FIG. 4 are only intended as schematic representations. As a consequence of the protruding knuckles 40, a piece of the structured clothing 12 that has a given length will have a larger surface area (i.e. contact area for the fibrous web W) than the endless belt 11, at least compared to the side of the endless belt 11 that has a smooth polymer-covered surface. The surface area for a given structured clothing 12 depends on the surface structure of the structured clothing such as the number of yarns per 100 mm in the CD and MD directions and the thickness of the yarns when the structured clothing 12 is a woven fabric. To verify the actual surface area of a given clothing, X-ray computed tomography may be used.

The fibrous web W is transferred to the structured clothing 12 from the endless belt 11 in a transfer nip TN formed between a first transfer nip roll 14 that lies within the loop of the endless belt 11 and a second transfer nip roll 15 which is a suction roll located within the loop of the structured clothing 12. The transfer nip TN has a length in the machine direction which is in the range of 5 mm-40 mm. After the transfer to the structured clothing 12, the fibrous web W is conveyed to a drying cylinder 17. Normally, but not necessarily, the drying cylinder 17 is a Yankee drying cylinder, for example a cast drying cylinder but it may also be a welded steel cylinder as disclosed in, for example, WO 2008/105005. The fibrous web W is dried on the drying cylinder 17 and the dried fibrous web W is subsequently creped from the drying cylinder 17 by a doctor 18 as is known in the art.

According to an advantageous aspect of the invention, the operation of the transfer nip TN is carried out in such a way that the structured clothing 12 is operated at a speed which is lower than the speed of the endless belt 11. However, the difference in speed is selected such that the relative difference in speed between the endless belt 11 and the structured 12 fabric corresponds to the relative difference in surface area between the endless belt 11 and the structured clothing 12. The web is to some extent pushed together in the machine direction but only to the extent that is required to correspond to the extra area of the structured clothing. Thereby, the fibers in the fibrous web will not be pushed together into regions of more fibers and they will not be torn away from each other to form regions of less fibers. Instead, the fibers of the fibrous web W will be evenly distributed on the structured clothing 12. The fibrous web conforms to the surface contour of the structured clothing such that it forms a pattern of elevations and depressions that serves to improve the bulk, absorbency and softness of the fibrous web but the structure of the web and the distribution of fibers remain substantially undisturbed. Although the web has been manufactured without through-air drying, bulk, absorbency and softness are only somewhat lower than what can be achieved with through-air drying—but the method used is much more energy effective. The fibrous web produced has a uniform strength due to the even fiber distribution which is good for handling of the fibrous web. For example, if a part of the structured clothing 12 with a given length and width has the area A and a part of the endless polymer-covered belt 11 of equal length and width has the surface area which is 95% of the area A, the structured clothing 12 must be run slower than the endless belt by about 5% such that the endless belt 11 may deliver the extra material required to cover the entire surface area of the structured clothing 12. If—hypothetically—the surface area of the structured clothing 12 was twice as large as the surface area of a corresponding part of the endless belt, the structured clothing 12 would have to run at only half the speed of the endless polymer-covered belt 11.

In realistic embodiments of the invention, large speed differences are unlikely to be used. With suitable structured clothings currently available, it is suitable that the speed of the endless belt 11 has a speed that is 2%-18% higher than the speed of the structured clothing 12. In this context, a speed difference of 18% probably represents an upper limit or a value close to an upper limit. In the majority of cases, the speed difference should be no greater than 12% such that a suitable speed difference may lie in the range of 3%-12% or 2%-9%. For example, in many realistic embodiments, the speed difference may be about 5%. This does not mean that it is impossible to manufacture structured tissue products by methods in which the speed difference is larger than 18%. Processes are possible in which the speed difference may be 20%, 25% or higher but with such large speed differences, it becomes harder to achieve the even fiber distribution that the present invention seeks to achieve.

The structured clothing may take many different forms. For example synthetic materials/polymer materials in which a pattern is etched may be considered but it may be a practical solution to use a structured clothing which comes in the form of a woven fabric. With reference to FIG. 4, a structured clothing 12 is shown which comprises yarns 43 extending in the cross machine direction CD and yarns 44 extending in the machine direction MD and which yarns 43, 44 are interwoven with each other to form a structured clothing with protruding knuckles 40. In the embodiment of FIG. 4, the yarns 43, 44 form the protruding knuckles 40 in those parts where they protrude from the surface of the clothing 12. In principle, the yarns 43, 44 may be interwoven to form many different patterns of protruding knuckles and intermediate depressions. However, in advantageous embodiments of the invention, the yarns 43, 44 are interwoven with each other in such a way that, on the side of the structured clothing 12 that faces the fibrous web W, the protruding knuckles 40 formed by the yarns 43, 44 have a greater extension in the machine direction MD that in the cross machine direction CD, i.e. they are oriented mainly in the machine direction MD. The inventors have found that such an orientation of the knuckles 40, i.e. when the knuckles are mainly oriented in the machine direction, makes it easier to achieve an even distribution of the fibers during transfer to the structured clothing, i.e. there should be no areas with more or less fibers than neighboring areas.

The structured clothing 12 may take such forms that it has yarns with a diameter in the range of 0.30 mm-0.55 mm and an air permeability in the range of 550-650 cfm.

An example of a structured clothing 12 that could be used for the present invention is a woven fabric that is currently (May 2016) sold by Albany International under the name ProLux 593S. This fabric has, in the machine direction (MD), 18.2-18.7 yarns/cm and, in the cross direction (CD), 10.8-11.0 yarns/cm. The thickness (diameter) of the yarns 44 in the machine direction may be 0.3-0.4 mm and the yarns 43 in the CD direction may have thickness of 0.5 mm. The number of knuckles 49/cm2 may be 25. When the structured clothing 12 is a fabric such as the ProLux 593S and the endless belt 11 has a smooth surface, the inventors have found that a speed difference of 8% between the endless belt 11 and the structured clothing 12 corresponds well to the difference in surface area between the belt 11 and the clothing 12 such that the fibers of the fibrous web W will be evenly distributed without regions that have become fiber-enriched compared to surrounding areas.

It should be noted that a structured permeable clothing can take many different forms and be manufactured in many different ways. For example, a method of making permeable clothings are disclosed in, for example, U.S. Pat. No. 6,193,847.

In embodiments of the invention, the fibrous web W may be dewatered in the dewatering nip PN to a dry solids content which is in the range of 40%-50%, preferably to a dry solids content which is in the range of 45-50%. Dewatering to such levels will save much energy during later drying but if the fibrous web is dewatered too much, it may become more difficult to make the fibrous web adapt to the three-dimensional shape of the structured clothing.

Optionally, a vacuum box 16 may be arranged within the loop of the structured clothing 12 at a point between the transfer nip TN and the drying cylinder 17 and arranged to act on the fibrous web W through the structured clothing 12 at an internal underpressure in the vacuum box 16 which is in the range of 40 kPa-70 kPa, preferably 55 kPa-65 kPa. The vacuum box 16 may further assist in making the fiber web W adapt to the structured clothing 12.

After the fibrous web W has been transferred to the structured clothing, the fibrous web W is preferably transferred to the drying cylinder 17 in a transfer nip between the drying cylinder 17 and a third transfer nip roll 20 located inside the loop of the structured clothing 12. A suitable linear load in the transfer nip between the drying cylinder 17 and the third transfer nip roll 20, may be in the range of 30 kN/m-90 kN/m, preferably in the range of 65 kN/m-75 kN/m. The linear load should be sufficient to cause the fibrous web W to adhere to the surface of the drying cylinder but not to compress it too much.

The fibrous web W is dried on the drying cylinder 17 and subsequently creped from the surface of the drying cylinder 17 by means of the doctor 18.

In embodiments of the invention, the dried fibrous web W is calendered after it has been creped from the surface of the drying cylinder 17 to improve softness and smoothness of the web W but it should be understood that the calendering step and the calender rolls 31, 30 that form a calendering nip in FIG. 1 are optional.

After the (optional) calendering step, the web W it can be passed to a reel-up. In FIG. 1, a paper roll 24 is formed on a reeling drum 25. Reference numeral 19 refers to a supporting cylinder. It should be understood that any kind of reel-up suitable for tissue grades may be used.

As conventional in the art of papermaking, the forming step is carried out in such a way that a head box 1 ejects stock over a forming fabric or into a gap between two forming 3, 5 fabrics. In some embodiments of the invention, the speed of the stock ejected from the head box 1 is lower than the speed of the forming fabric or forming fabrics 3, 5 such that the fibers in the stock obtain an orientation that is biased in the machine direction MD. In this way, the MD tensile strength of the fibrous web may be improved.

Creping the web improves bulk, softness and MD stretch.

A fibrous web according to the present invention will now be discussed with reference to FIGS. 5-8.

Figure 6:
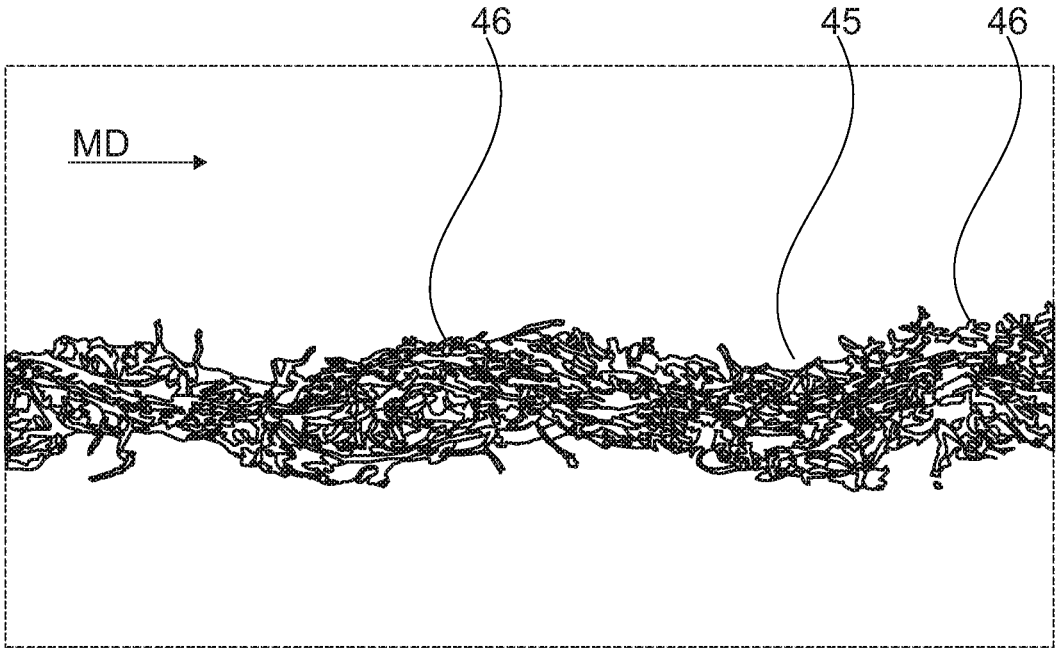
FIG. 6 is a photograph showing a cross sectional view of a creped fibrous web according to the invention along the machine direction.

The inventive fibrous web W will have a basis weight in the range of 14 g/m2-40 g/m2 or, in many cases, 14 g/m2-28 g/m2. As best seen in FIG. 6, it has a three-dimensional structure formed by depressed regions 45 and elevated regions 46. The fibers of the fibrous web W are evenly or substantially evenly distributed over the surface of the creped fibrous web W such that there are no areas with more or less fibers. While there are regions where the fibers have been more compressed, the actual distribution of fibers is the same. Naturally, the shape of the web which in microscopic scale appears "wavy" means that a measurement of basis weight may indicate variations in basis weight over the surface but this is not due to any uneven distribution of fibers, it is substantially an effect of the fact that, seen from above, the areas between the depressed regions 45 and the elevated regions 46, the web W is measured at an angle. The fibrous web has an MD/CD tensile ratio in the range of 1.1-2.7. The MD/CD tensile ratio can be controlled by, for example, controlling relative speed between the forming wire(s) and the stock ejected from the head box 1. The caliper of the fibrous web is in the range of 170 μm-350 μm or 173 μm-296 μm (using the thickness measurement method according to ISO 12625-3) and it has a water absorbency in the range of 8 g/g-14 g/g (measured using the basket method according to: ISO 12625-8).

Figure 5:
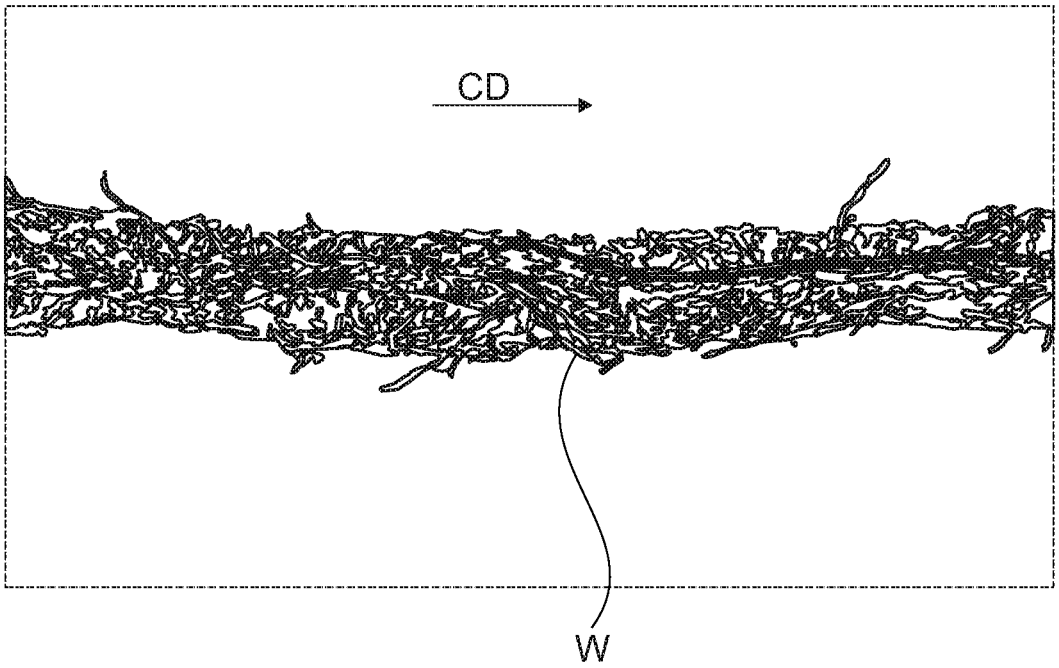
FIG. 5 is a photograph showing a cross sectional view of a creped fibrous web according to the invention along the cross machine direction.

As can be seen in both FIG. 5 and FIG. 6, the distribution of fibers is even with no areas where there is significantly more fibers or less fibers.

Figure 7:
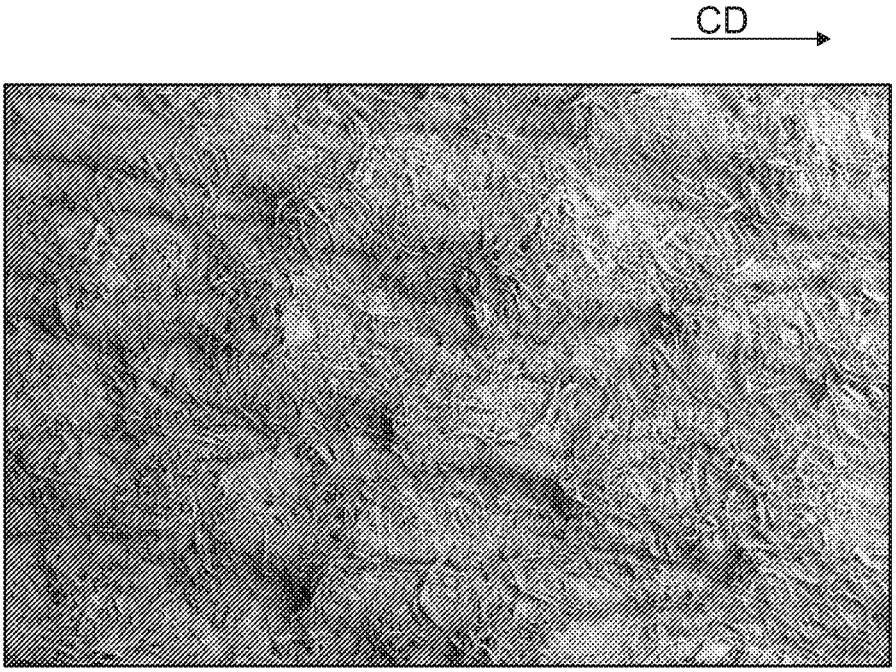
FIG. 7 is a photograph from above of a fibrous web according to the invention and showing the marked side which has contacted the structured clothing.
Figure 8:
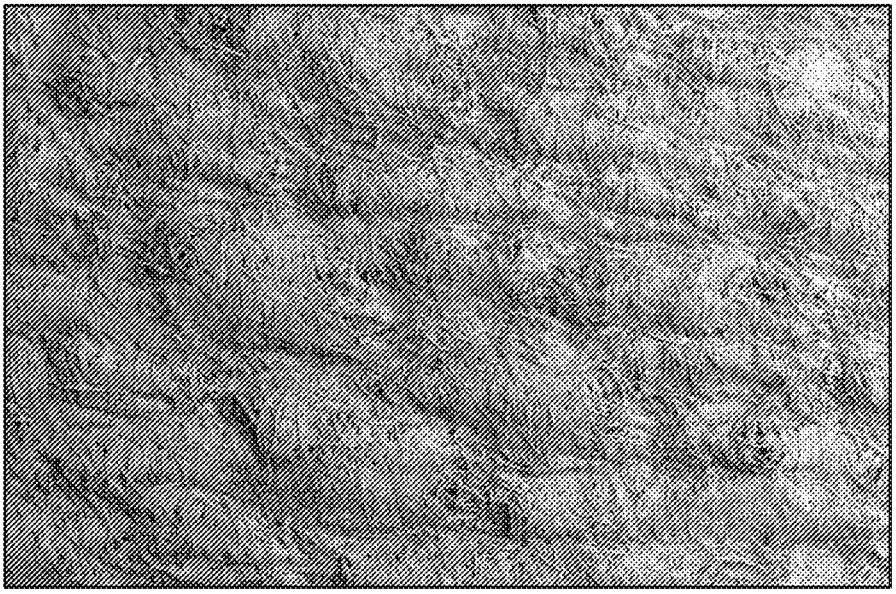
FIG. 8 is a photograph from above showing the unmarked side of the fibrous web, i.e. the side which has nor contacted the structured clothing.

FIG. 7 shows the marked side of the web from above and FIG. 8 shows the unmarked side. In both FIG. 7 and FIG. 8, the CD direction is from the left to the right in the figures.

The fibrous web shown by the photographs according to FIG. 5-8 has been made at a speed difference of about 10%.

The fibrous web according to the invention has a good tensile strength in the machine direction and the even distribution of the fibers means that there is a reduced risk for weak spots which facilitates handling such as for rewinding purposes.

Preferably, the dominant orientation of the depressed and elevated regions 45, 46 is in the machine direction MD of the fibrous web.

In embodiments of the invention, the creped fibrous web (W) has an MD stretch of 16%-30%.

In embodiments of the invention, the dominant orientation of the fibers is in the machine direction MD of the fibrous web W.

The invention claimed is:

1. A method of making a structured fibrous web (W), the method comprising the steps of:

forming a fibrous web (W) and conveying the formed fibrous web on a water receiving felt (5) to a dewatering nip (PN) formed by a first press unit (8) and a second press unit (9) and where an endless belt (11) is passed through the nip together with the fibrous web (W) and the water receiving felt (5), the endless belt (11) having a plain side which is covered by a polymer and which contacts the fibrous web (W) in the dewatering nip (PN);

determining a relative difference in surface area between the endless belt (11) and an endless structured clothing (12) and selecting relative belt and clothing speeds for the endless belt (11) and the structured clothing (12), respectively;

after the dewatering nip (PN), conveying the fibrous web (W), by the endless belt (11) travelling at the belt speed, to an endless structured clothing (12) which is permeable to air and has protruding knuckles (40) on the side that contacts the fibrous web (W) and which protruding knuckles (49) give the structured clothing (12) a topographic surface area which, for a given length of the structured clothing (12) in the machine direction and a given width of the structured clothing in the cross machine direction, exceeds the plain surface area of a part of the endless belt (11) having an equal length and width, and to which structured clothing (12) the fibrous web (W) is transferred from the endless belt (11) in a transfer nip (TN) formed between a first transfer nip roll (14) that lies within the loop of the endless belt (11) and a second transfer nip roll (15) which is a suction roll located within the loop of the structured clothing (12), the transfer nip (TN) having a length in the machine direction which is in the range of 5 mm-40 mm; and after the transfer to the structured clothing (12), conveying the fibrous web (W), by the structured clothing (12) travelling at the clothing speed, to a drying cylinder (17), drying the fibrous web (W) on the drying cylinder (17), and subsequently creping the dried fibrous web (W) from the drying cylinder (17), wherein:

the clothing speed at which the structured clothing (12) is operated is lower than the belt speed of the endless belt (11), and the relative difference in the clothing and belt speeds corresponds to the determined relative difference in the surface area between the endless belt (11) and the structured clothing (12), such that the fibers of the fibrous web (W) are evenly distributed on the structured clothing (12).

2. A method according to claim 1, wherein the structured clothing (12) has yarns (43, 44) extending in the cross machine direction (CD) and in the machine direction (MD) and which yarns (43, 44) form the protruding knuckles (40) and wherein, on the side of the structured clothing (12) that faces the fibrous web (W), the protruding knuckles (40) formed by the yarns (43, 44) have a greater extension in the machine direction (MD) that in the cross machine direction (CD).

3. A method according to claim 1, wherein the fibrous web (W) is dewatered to a dry solids content in the range of 40%-50% in the dewatering nip (PN).

4. A method according to claim 1, wherein the belt speed of the endless belt (11) is 2%-18% higher than the clothing speed of the structured clothing (12).

5. A method according to claim 1, wherein the linear load in the dewatering nip (PN) is in the range of 250-700 kN/m corresponding to a peak pressure of 2.5 MPa-7 MPa.

6. A method according to claim 1, wherein the suction roll in the transfer nip (TN) is operated at an internal underpressure in the range of 20 kPa-65 kPa.

7. A method according to claim 1, wherein the transfer nip (TN) between the first transfer nip roll (14) and the second transfer nip roll (15) is operated at a linear load in the range of 4 kN/m-15 kN/m.

8. A method according to claim 1, wherein a vacuum box (16) is arranged within the loop of the structured clothing (12) at a point between the transfer nip (TN) and the drying cylinder (17) and arranged to act on the fibrous web (W) through the structured clothing (12) at an internal underpressure in the vacuum box (16) which is in the range of 40 kPa-70 kPa.

9. A method according to claim 1, wherein the fibrous web (W) is transferred to the drying cylinder (17) in a transfer nip between the drying cylinder (17) and a third nip roll (20) located inside the loop of the structured clothing (12) and wherein the linear load in the transfer nip between the drying cylinder (17) and the third transfer nip roll (20), the linear load in the transfer nip between the drying cylinder (17) and the third transfer nip roll (20) being in the range of 30 kN/m-90 kN/m.

10. A method according to claim 1, wherein the dried fibrous web (W) is calendered after it has been creped from the surface of the drying cylinder (17).

11. A method according to claim 2, wherein the structured clothing (12) has yarns with a diameter in the range of 0.30 mm-0.55 mm and an air permeability in the range of 550-650 cfm.

12. A method according to claim 1, wherein the forming step is carried out in such a way that a head box (1) ejects stock over a forming fabric or into a gap between two forming (3, 5) fabrics and the speed of the stock ejected from the head box (1) is lower than the speed of the forming fabric or forming fabrics (3, 5) such that the fibers in the stock obtain an orientation that is biased in the machine direction (MD).

13. A method according to claim 1, wherein the fibrous web (W) is dewatered to a dry solids content in the range of 45%-50%.

14. A method according to claim 1, wherein the belt speed of the endless belt (11) is 3%-12% higher than the clothing speed of the structured clothing (12).

15. A method according to claim 1, wherein the suction roll in the transfer nip (TN) is operated at an internal underpressure in the range of 45 kPa-65 kPa.

16. A method according to claim 1, wherein the suction roll in the transfer nip (TN) is operated at an internal underpressure in the range of 48 kPa-58 kPa.

17. A method according to claim 1, wherein the transfer nip (TN) between the first transfer nip roll (14) and the second transfer nip roll (15) is operated at a linear load in the range of 4 kN/m-10 kN/m.

18. A method according to claim 8, wherein the internal underpressure in the vacuum box (16) is in the range of 55 kPa-65 kPa.

19. A method according to claim 9, wherein the linear load in the transfer nip between the drying cylinder (17) and the third transfer nip roll (20) is in the range of 65 kN/m-75 kN/m.

* * * * *